US010384331B2

(12) United States Patent
Maggert

(10) Patent No.: US 10,384,331 B2
(45) Date of Patent: Aug. 20, 2019

(54) VISE WITH AXIAL ADJUSTMENT AND MODULAR JAWS

(71) Applicant: Dustin B. Maggert, Piqua, OH (US)

(72) Inventor: Dustin B. Maggert, Piqua, OH (US)

(73) Assignee: TE-CO MANUFACTURING LLC, Union, OH (US)

( * ) Notice: Subject to any disclaimer, the term of this patent is extended or adjusted under 35 U.S.C. 154(b) by 490 days.

(21) Appl. No.: 14/789,502

(22) Filed: Jul. 1, 2015

(65) Prior Publication Data

US 2017/0001284 A1 Jan. 5, 2017

(51) Int. Cl.
*B25B 1/10* (2006.01)
*B25B 1/24* (2006.01)

(52) U.S. Cl.
CPC ..... *B25B 1/103* (2013.01); *B25B 1/2457* (2013.01)

(58) Field of Classification Search
CPC ..... B25B 1/103; B25B 1/125; B25B 5/107; B25B 1/2484; B25B 1/2489
USPC ..... 269/218
See application file for complete search history.

(56) References Cited

U.S. PATENT DOCUMENTS 1,008,926 A * 11/1911 Saylor ..... B25B 1/08 269/218
1,549,278 A 8/1925 Sundstrand
2,480,415 A 8/1949 Mettler
3,727,772 A 4/1973 Pauls
3,834,435 A 9/1974 McCord, Jr.
4,251,066 A 2/1981 Bowling
4,429,887 A * 2/1984 Smith ..... B23B 31/1605 269/74
4,591,199 A 5/1986 Zajac
4,798,371 A 1/1989 Wallisser
4,928,937 A 5/1990 Bernstein
4,934,674 A 6/1990 Bernstein
5,015,003 A 5/1991 Ramunas
5,060,920 A 10/1991 Engibarov
(Continued)

FOREIGN PATENT DOCUMENTS

CN 201913557 8/2011
CN 203390762 1/2014
(Continued)

OTHER PUBLICATIONS

Product Information featuring "Makro-Grip® 5-Axis Vise—Compact and unmatched holding strength for the 5-face-machining of unfinished parts" by Lang Technovation.com (2013).
(Continued)

*Primary Examiner* — Joseph J Hail
*Assistant Examiner* — J Stephen Taylor
(74) *Attorney, Agent, or Firm* — Thompson Hine LLP

(57) ABSTRACT

A vise including a body, a threaded shaft extending through or positioned adjacent to the body, and a block coupled to the body and spaced away from an axial end of the shaft. The vise further includes a pair of carriages carried on the shaft and configured such that rotation of the shaft about a central axis thereof causes each carriage to move axially along the shaft. The vise also includes a pair of clamps releasably coupled to the shaft and positioned adjacent to the block on opposite sides thereof. Each clamp is adjustable axially along the shaft to enable adjustment of an axial position of the shaft relative to the block.

17 Claims, 9 Drawing Sheets

(56) References Cited

U.S. PATENT DOCUMENTS

| | | | | |
|---|---|---|---|---|
| 6,170,813 | B1 | 1/2001 | Bowers | |
| 6,206,354 | B1 * | 3/2001 | Lin | B25B 1/103 269/136 |
| 6,957,809 | B1 | 10/2005 | Ferrara et al. | |
| 7,163,201 | B2 | 1/2007 | Bernstein | |
| 8,020,877 | B2 | 9/2011 | Lang | |
| 8,158,242 | B2 | 4/2012 | Nishihata et al. | |
| 8,226,075 | B2 | 7/2012 | Nelson | |
| 8,322,699 | B2 | 12/2012 | Prell et al. | |
| 8,540,225 | B2 | 9/2013 | Ehnstrom | |
| 8,672,310 | B2 | 3/2014 | O'Rell et al. | |
| 9,126,299 | B2 | 9/2015 | O'Rell et al. | |
| 2010/0219573 | A1 | 9/2010 | O'Rell et al. | |
| 2012/0068393 | A1 | 3/2012 | Van de Voss et al. | |
| 2014/0001692 | A1 | 1/2014 | Schmidt | |
| 2014/0131933 | A1 * | 5/2014 | Taylor | B25B 1/24 269/165 |
| 2014/0197587 | A1 | 7/2014 | O'Rell et al. | |

FOREIGN PATENT DOCUMENTS

| | | | | |
|---|---|---|---|---|
| DE | 2848229 | B1 * | 12/1979 | B25B 1/103 |
| DE | 202015103174 | U1 * | 6/2015 | B25B 1/103 |
| EP | 0742081 | | 11/1996 | |
| FR | 659984 | A * | 7/1929 | B25B 1/24 |
| KR | 20-0471246 | | 2/2014 | |
| SU | 1750922 | | 7/1992 | |

OTHER PUBLICATIONS

Blog by pepo "Left hang/right hand thread centering" www.practicalmachinist.com/vb/cnc-machining/left-hand-right-hand-thread-centering-123177/ (retrieved from internet on Aug. 20, 2014).

Webpage featuring "Threaded-Bore One-Piece Clamp-on Shaft Collar" by McMaster-Carr http://www.mcmaster.com/ (retrieved from internet on Sep. 30, 2014).

* cited by examiner

VISE WITH AXIAL ADJUSTMENT AND MODULAR JAWS

The present invention is directed to a vise for clamping workpieces, and more particularly, to a vise with an axial adjustment feature and/or replaceable, modular jaw inserts.

BACKGROUND

Vises are often used to clamp and secure workpieces in place for manufacturing, machining and other industrial operations. In many cases, the vise is a double-acting vise in which a pair of jaws are each moveable toward or away from the other to grip the workpiece therebetween. It may be desired that the jaws in such a double-acting vise be precisely aligned such that, in one case, the jaws are centered relative to a body of the vise to ensure proper alignment and positioning. However, adjustment/centering features for existing vises can be difficult to operate and/or access.

The jaws of a vise can also experience wear and tear over time, and therefore require removal or replacement. In addition, a single vise may be desired to be used in differing applications which require differing jaws. However, existing vises may not sufficiently provide for such removal or replacement of the jaws, or parts thereof.

SUMMARY

In one embodiment, the present invention is a vise in which the jaws (and/or carriages upon which the jaws are carried) are adjustable to ensure precise centering and calibration. In another embodiment the present invention is a vise including a modular, replaceable insert for the jaws. More particularly, in one embodiment the invention is a vise including a body, a threaded shaft extending through or positioned adjacent to the body, and a block coupled to the body and spaced away from an axial end of the shaft. The vise further includes a pair of carriages carried on the shaft and configured such that rotation of the shaft about a central axis thereof causes each carriage to move axially along the shaft. The vise also includes a pair of clamps releasably coupled to the shaft and positioned adjacent to the block on opposite sides thereof. Each clamp is adjustable axially along the shaft to enable adjustment of an axial position of the shaft relative to the block.

DETAILED DESCRIPTION

Figure 1:
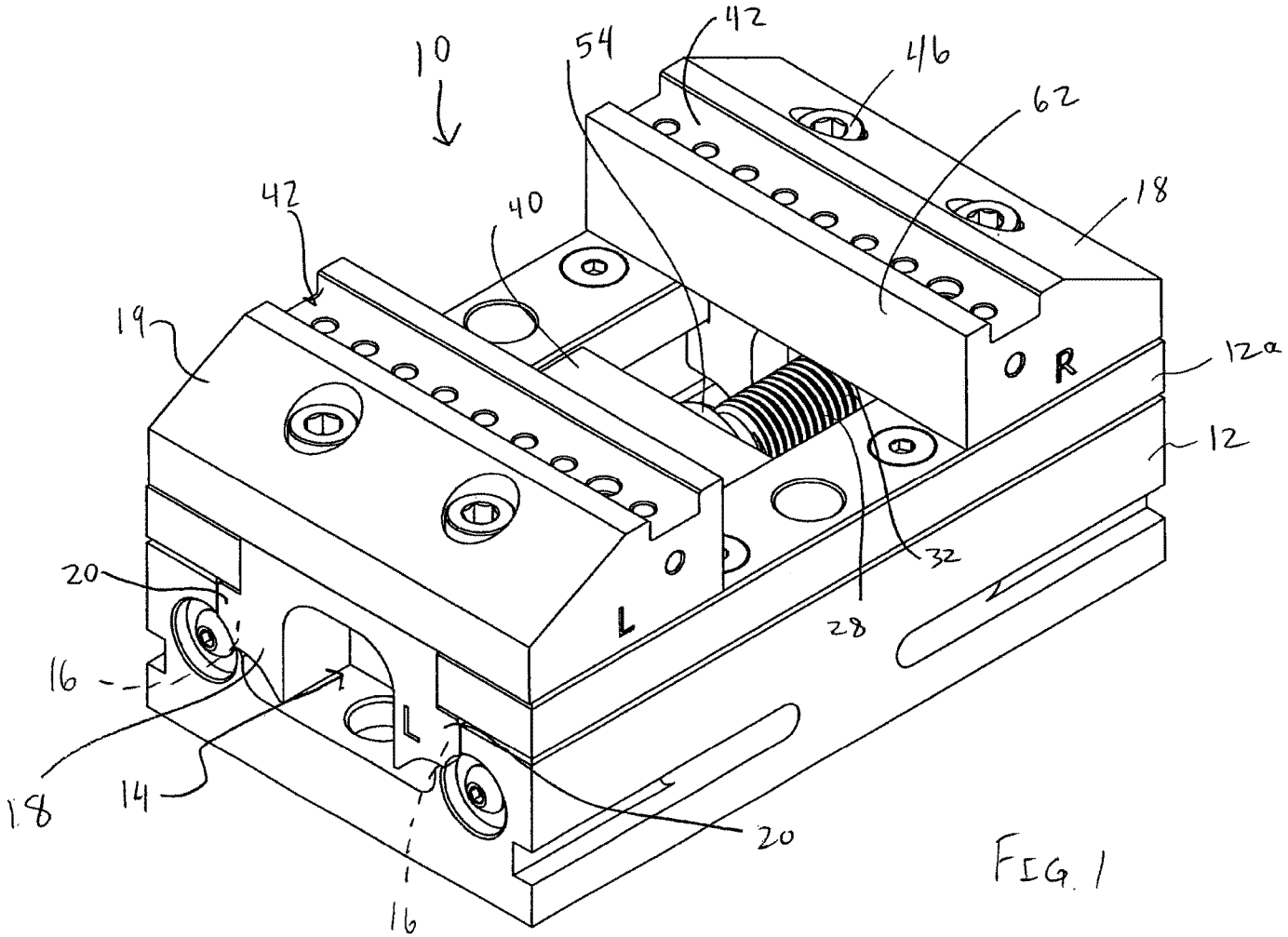
FIG. 1 is an upper perspective view of one embodiment of the vise of the present invention.

With reference to FIGS. 1-7, in one embodiment the present invention takes the form of a vise, generally designated 10, including a body 12 having a rail portion 12*a*. The body 12 and rail portion 12*a* can include a central, longitudinally extending channel or groove 14 extending in an axial direction thereof, with the channel 14 including a pair of opposed outer recesses 16. The vise 10 further includes a pair of carriages 18 slidably coupled to the body 12 via a shaft 28 and received in the channel 14 of the body 12/rail portion 12*a*. Each carriage 18 includes a pair of outwardly-extending flanges 20, with each flange 20 being closely received in a corresponding recess 16. The carriages 18 can be slidably coupled to the body 12 by various other arrangements. For example, in one case the position of protrusions 20 and recesses 16 can be reversed such that one or both of the protrusions 20 are positioned on the body 12, and one or both of the recesses 16 are positioned on the carriages 18.

Each carriage 18 coupled to or includes a corresponding jaw 19 on the upper end thereof, and each jaw 19 can be considered to be part of the associated carriage 18. The body 12 can be generally fixed and non-moveable, and in one embodiment is coupled to a base 22 (FIGS. 2-5) via a set of fasteners 24 and/or pins 26. The base 22 can, in turn, be coupled to a work table, work surface, mechanical device or the like to secure the vise 10 in place.

The vise 10 can include a threaded shaft 28 at least partially positioned in the channel 14 and extending through, or positioned adjacent to, the body 12. The shaft 28 extends axially and has a central axis aligned with the longitudinal axis of the channel 14/vise 10, and includes two threaded portions 30, 32 at opposite ends thereof. The threaded portions 30, 32 are threaded in opposite orientations (i.e., one with a left handed thread and one with a right handed thread), for purposes which will be described in greater detail below. Each carriage 18 is threadably coupled to differing threaded portions 30, 32 at opposite ends of the threaded shaft 28.

In the illustrated embodiment, a center portion 34 of the shaft 28 is of a reduced diameter and is also threaded. In particular, in one case the center portion 34 of the shaft 28 includes two threaded portions 36, 38, which can be threaded in the same or opposite directions, although the entire center/reduced diameter portion 34 can have a single continuous thread if desired. However, in an alternate embodiment the center/reduced diameter portion 34 of the shaft 28 is not threaded and could in one case be knurled or roughened, but need not necessarily have any particular specialized shape, treatment or configuration, and thus may not even be knurled or roughened in some cases.

The vise 10 can include a center block 40, having an opening 41 formed therein and coupled to or forming part of the body 12. In one embodiment the center block 40 is centered along a longitudinal direction of the channel 14/body 12. The shaft 28 is received through the center block 40 such that the center/reduced diameter portion 34 of the shaft 28 extends through the center block 40. The center/reduced diameter portion 34 of the shaft 28 can in one case have a smaller diameter than the opening 41 of the center block 40 such that the shaft 28 passes unimpeded through the center block 40, and thus does not engage or contact the center block 40.

Figure 5:
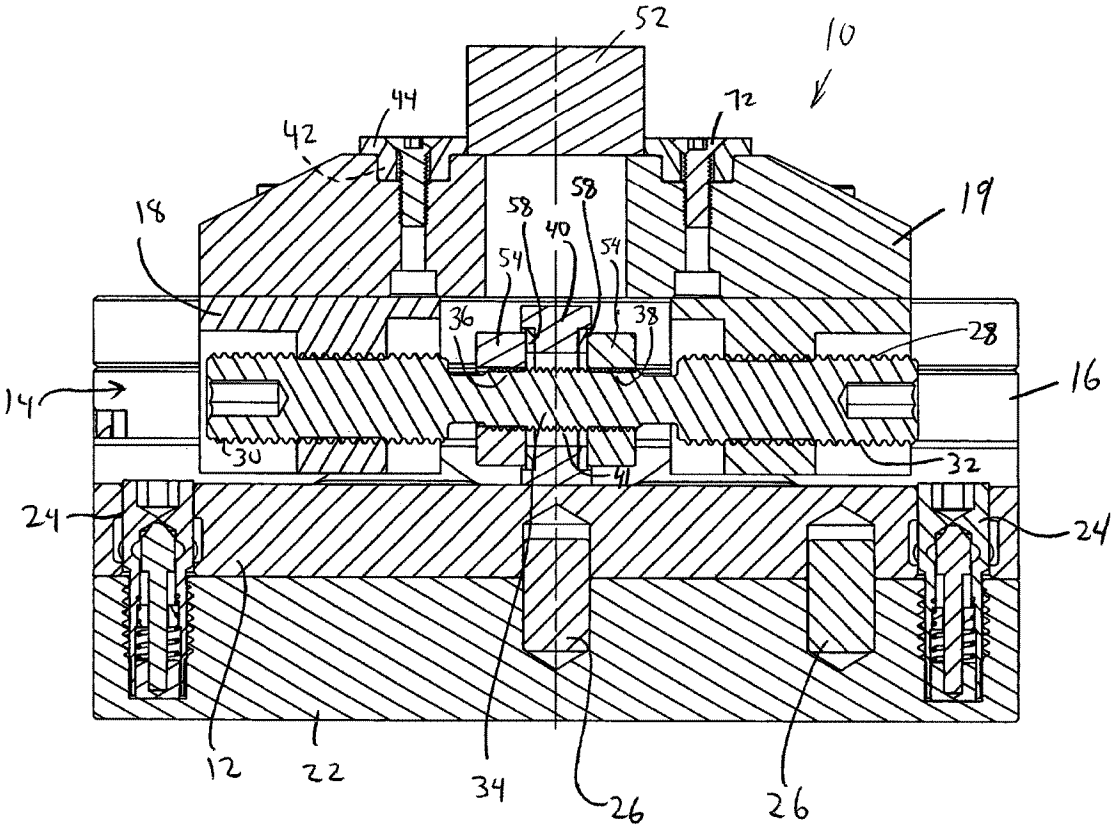
FIG. 5 is a side cross section of the vise of FIG. 4, with the carriages/jaws centered after an adjustment of the shaft collars and shaft.
Figure 6:
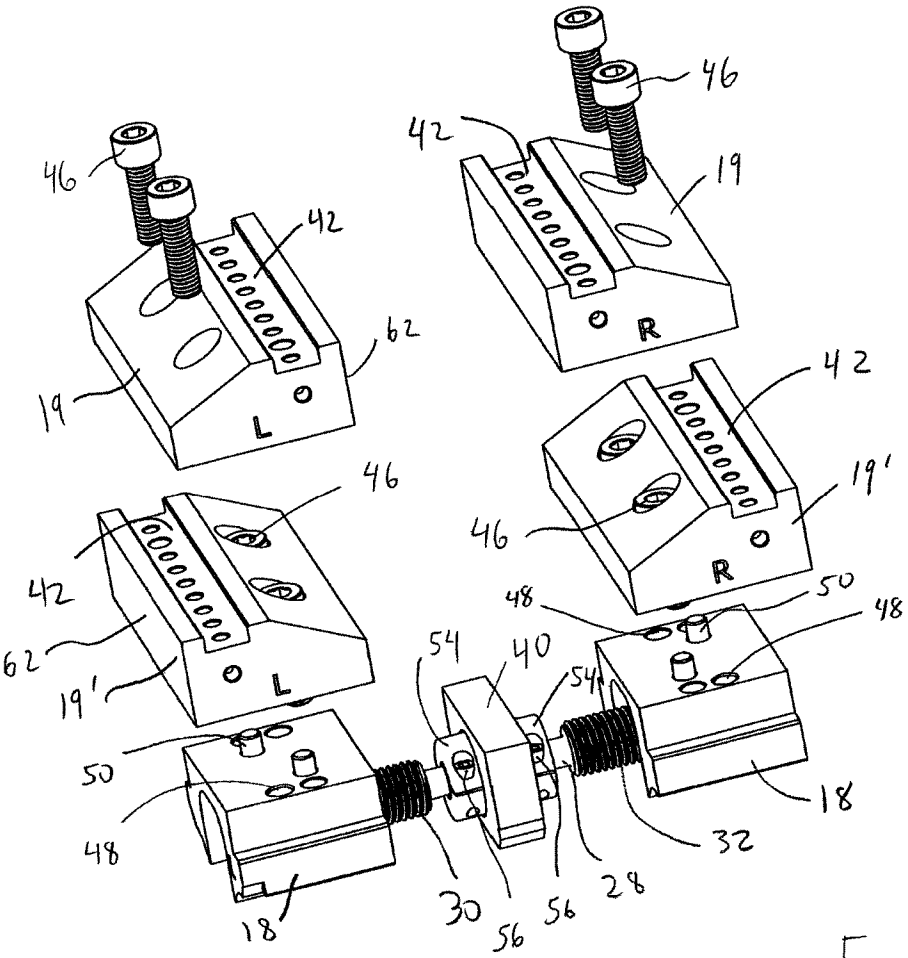
FIG. 6 is an exploded perspective view of the jaws/carriages of FIG. 1, and showing the reversible nature thereof.

With reference to FIG. 6, in one embodiment each jaw 19 is attachable to the corresponding carriage 18 by a pair of fasteners 46. Each jaw 19 can include a groove 42 which can receive an insert 44 therein, as shown in FIGS. 2-5. The upper set of jaws 19 in FIG. 6 illustrate the configuration in FIGS. 1-5 in which the grooves 42 are positioned closer to each other. However, if desired the jaws 19 can be reversed and arranged in the configuration shown as jaws 19' in FIG. 6, in which the grooves 42 are positioned further away from each other. Each carriage 18 and jaw 19 can include a set of holes 48 which receive pins 50 therein to ensure the carriages 18 and jaws 19 are properly aligned in whichever configuration is utilized. The reversible nature of the 19 jaws enables the vise 10 to accommodate a wider range of sizes and shapes of workpieces.

The shaft 28 can be attachable to a crank or the like (not shown) which is manually or automatically rotatable to rotate the shaft 28 about its center axis. Rotation of the shaft 28 causes each carriage 18 (and associated jaws 19) to move either axially closer together or further apart from each other, due to the opposite threading arrangement of the end portions 30, 32 of the shaft 28. In this manner the vise 10 can be operated to grip or clamp workpieces between the jaws 19/inserts 44. For example, in one case a workpiece 52 can be gripped between the front faces of the jaws 19 or, alternately or in addition, between the front faces of the inserts 44 (FIGS. 2-5).

When the vise 10 is operated, it can be useful if the carriages 18 and jaws 19 are precisely located and positioned to ensure consistent, repeatable and predictable placement of a workpiece gripped therebetween; for example, in one case by centering the carriages 18 with respect to the vise 10/body 12. In this case, the alignment of the vise 10 can be ensured or detecting by moving the carriages 18 toward each other until the jaws 19/inserts 44 engage each other with no gap therebetween at a contact location. In this case it may be desired that the contact location be at a center point of the vise 10/body 12, or some other predetermined location.

Figure 7:
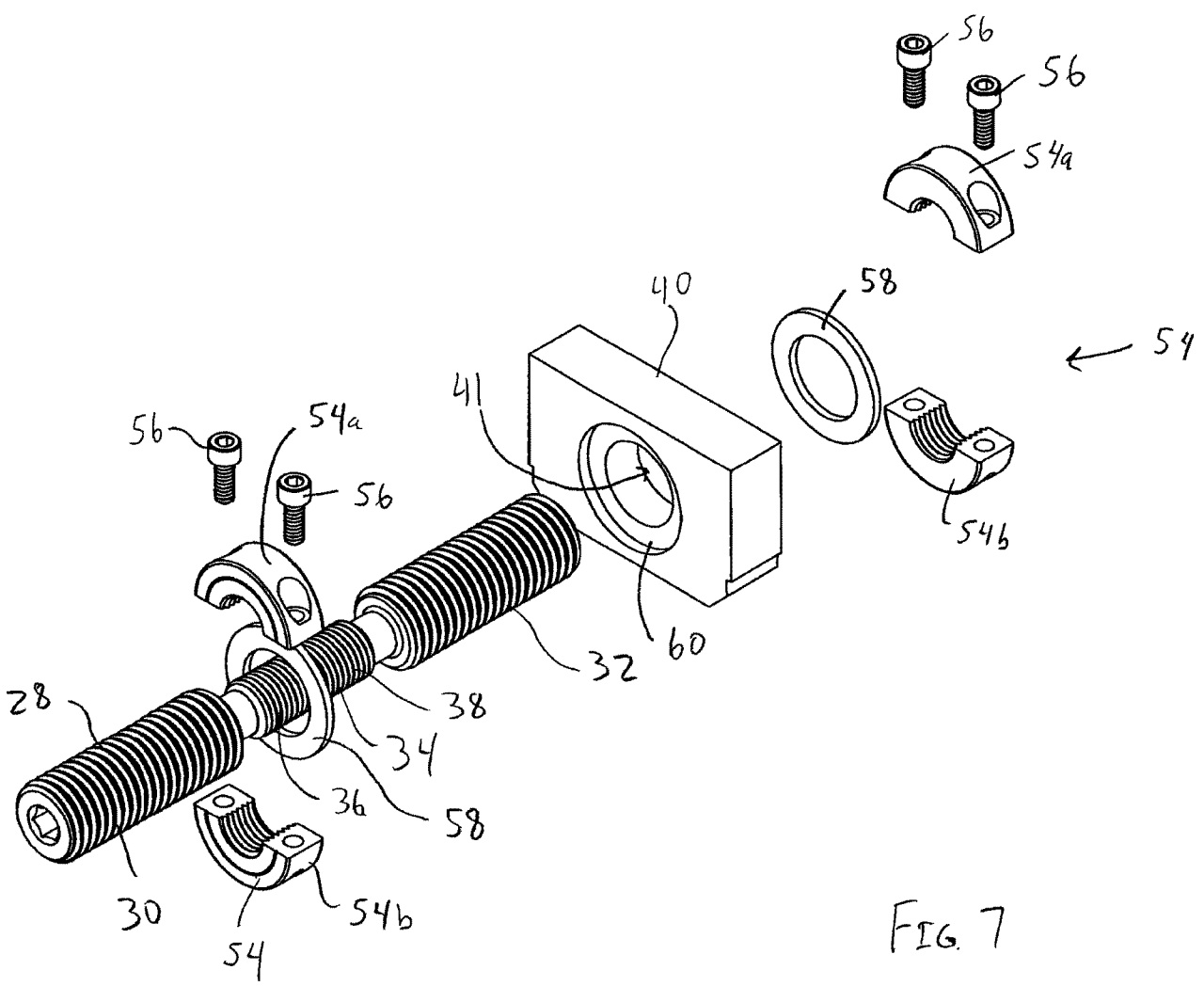
FIG. 7 is a further exploded view of certain components of FIG. 6 in the form of an adjustment mechanism.

In order to ensure that the vise 10 has the desired alignment, a pair of clamps 54 can be provided and positioned on the center/reduced-diameter portion 34 of the shaft 28. In particular, in the illustrated embodiment, each clamp 54 is generally "O" shaped and includes a central internally-threaded opening. In the illustrated embodiment, as shown in FIG. 7, each clamp 54 takes the form of a shaft collar, or is a two-piece clamp having two clamp portions 54*a*, 54*b*, each of which has a generally "C" or semi-circular shape. In this case the clamp portions 54*a*, 54*b* are separable from each other, but can be closed and clamped upon the reduced diameter portion 34 of the shaft 28 by utilizing fasteners 56 which extend through holes in the fastener portions 54*a*, 54*b* in a direction perpendicular to the central axis. In this manner each clamp 54 can be threaded and clamped onto the center portion 34 of the shaft 28, on opposite axial sides of the center block 40.

As shown in FIG. 2-5, each clamp 54 can be pressed up tight against the center block 40, in one case with a washer 58 (such as a thrust washer) positioned therebetween. As shown in FIG. 7, in one embodiment the center block 40 includes a shallow groove 60 on either side thereof to receive a washer 58 therein. In the illustrated embodiment, the clamps 54 are not received in or secured to the center block 40, but instead are secured only to the shaft 28. In particular, each clamp 54 is sized to be larger than the opening 41 of the center block 40 such that each clamp 54 is not receivable through or passable through the center opening 41. When the clamps 54 are threadably positioned on the shaft 28, the fasteners 56 are tightened down, and the clamps 54 engage the thrust washers 58 contained in the center block 40 (and/or could directly engage the center block 40), the clamps 54 prevent the shaft 28 from axially moving relative to the center block 40 and body 12. The clamps 54 can be tightened down on either side of the center block 40 during normal operating of the vise 10.

When it is desired to adjust the position of the shaft 28/carriages 18/jaws 19 and/or their center or meeting point relative to the center block 40 and the body 12, the fastener 56 of the clamps 54 can be slightly loosened until each clamp 54 can be threaded or otherwise axially moved along the reduced diameter portion 34 of the shaft 28. In this manner, each clamp 54 can be moved axially along the reduced diameter portion 34 of the shaft 28 until the clamp 54 is in the desired position (in one case, where the carriages 18/jaws 19 are centered along a length of the body 12), also moving the shaft 28/carriages 18/jaws 19 relative to the body 12. Once the shaft 28/carriages 18/jaws 19 are in the desired position, each clamp 54 is pressed tight against the center block 40, and locked in place via the fasteners 56. In this manner, the clamps 54 can be operated to adjust the axial position of the shaft 28/carriages 18/jaws 19 relative to the center block 40/body 12 to ensure, in one case, the carriages 18/jaws 19 meet at a center portion of the vise 10 for proper alignment.

Once the clamps 54 are tightened down, the vise 10 can be used and operated as desired. In operation of the vise 10, since the clamps 54 are rotatably coupled to the shaft 28, when the shaft 28 is rotated the clamps 54 are rotated with the shaft 28.

Figure 4:
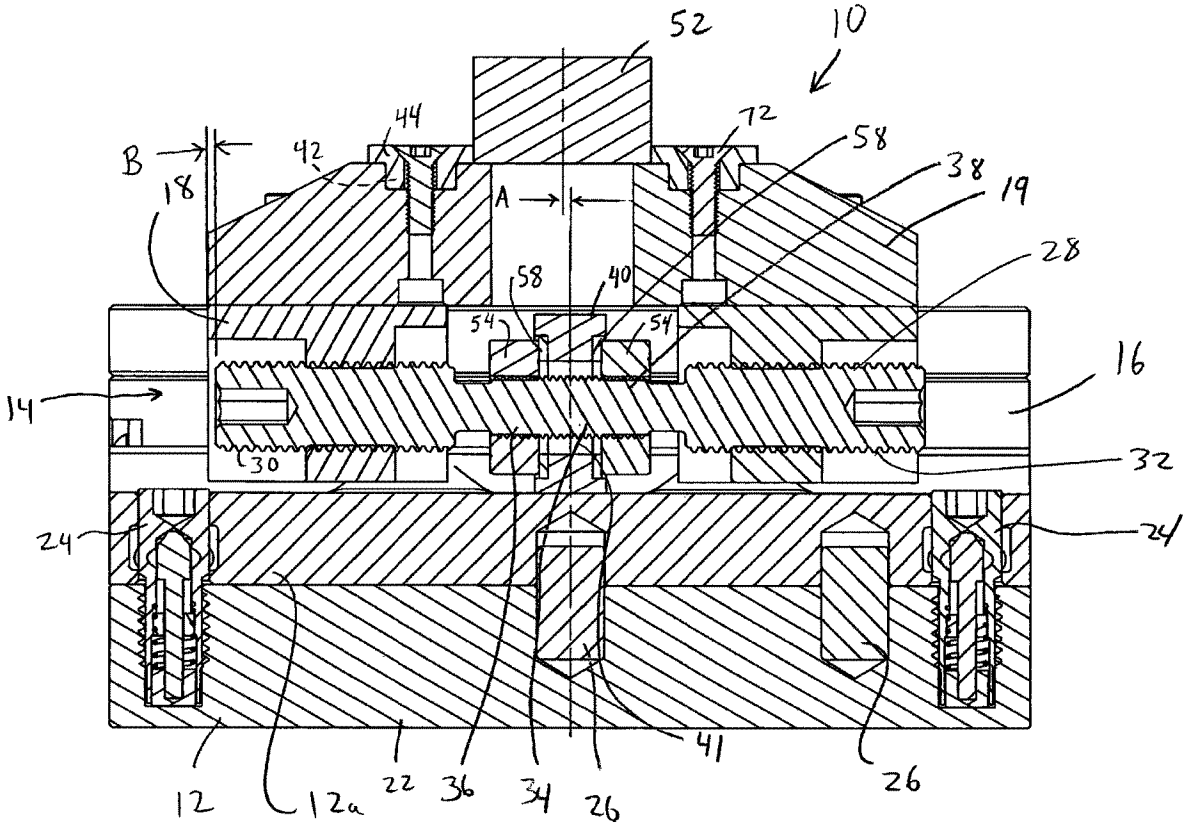
FIG. 4 is a side cross-section of the vise of FIG. 3, with the carriages/jaw off-center to the left from the position shown in FIG. 3.

To further illustrate the alignment process, FIG. 4 illustrates a case where the shaft 28 and carriages 18/jaws 19 may be considered out of alignment, and are not centered relative to the body 12 by the dimension A. In this particular illustrated case, the carriages 28 are out of alignment and are offset (moved to the left, in the illustrated embodiment) by dimension B, which causes the misalignment A. However, the misalignment A can be caused by a variety of other or different factors besides misalignment of the shaft 28, such as variances in shape or material of the parts, etc. FIG. 5 illustrates the case wherein the shaft 28 and carriages 18 have been centered relative to the body 12, compared to the position in FIG. 4, by loosening the clamps 54, moving them to the left along the shaft 28, moving the carriages 18/jaws 19 to the right and re-securing the clamps 54 in place to provide a desired axial adjustment, eliminating the offset A of FIG. 4

The axial adjustment of the carriages 18 relative to the center block 40/body 12 can be carried out by the manufacturer prior to shipping the vise 10. However, if desired, the moveable nature of the clamps 54 enables adjustment by a user in the field. The two-piece nature of the clamps 54 enables the clamp portions 54*a*, 54*b* to be entirely separated from each other, which can provide ease of assembly and adjustment. In particular, each clamp 54 can be positioned directly in place on the reduced diameter portion 34 of the shaft 28 and locked in place by securing the two clamp portions 54*a*, 54*b* together, without having to thread the clamp 54 along the entire length of the shaft 28, or along with reduced-diameter portion 34. The two-part, separable nature of the clamps 54 also enable the clamps 54 to be positioned in a variety of radial positions for access and tightening of the fasteners 56.

However, it should be understood that the clamps 54 can take any of a wide variety of other forms beyond that shown herein, for example, by using a one-piece clamp 54 which lacks two completely separable clamp portions. In addition, the clamps 54 need not necessarily be threadably coupled to the shaft 28; as outlined above, the shaft 28 can be knurled or roughened to enable the clamp 54 to grip the shaft and be locked in place, although the shaft 28 need not necessarily even be knurled or roughened. Nevertheless utilizing a threaded arrangement for the clamps 54 can provide for more accurate, fine adjustments.

In addition, the adjusting feature of the vise 10 (e.g. in one case the clamps 54 and center block 40) is located in the center of the vise 10 and/or away from the ends thereof, and away from either axial end or either threaded portions 30, 32 of the shaft 28. The center block 40 and/or clamps 54 may be located closer to the center of the shaft 28 than either axial end thereof. This positioning ensures that the body 12 can be secured to the base 22 at the ends of the vise 10, which might otherwise be blocked if the adjusting feature were to be located at an axial end of the shaft 28. Spacing the adjusting feature away from the axial ends also ensures greater functionality of the vise 10 by ensuring that the vise 10 can be stood on its end and used in a vertical configuration, with the shaft 28 aligned vertically, on either axial end for greater versatility, or trapped between two components. In addition, when the adjusting feature is spaced away from an axial end, the adjusting feature is protected from impact and other forces.

Figure 2:
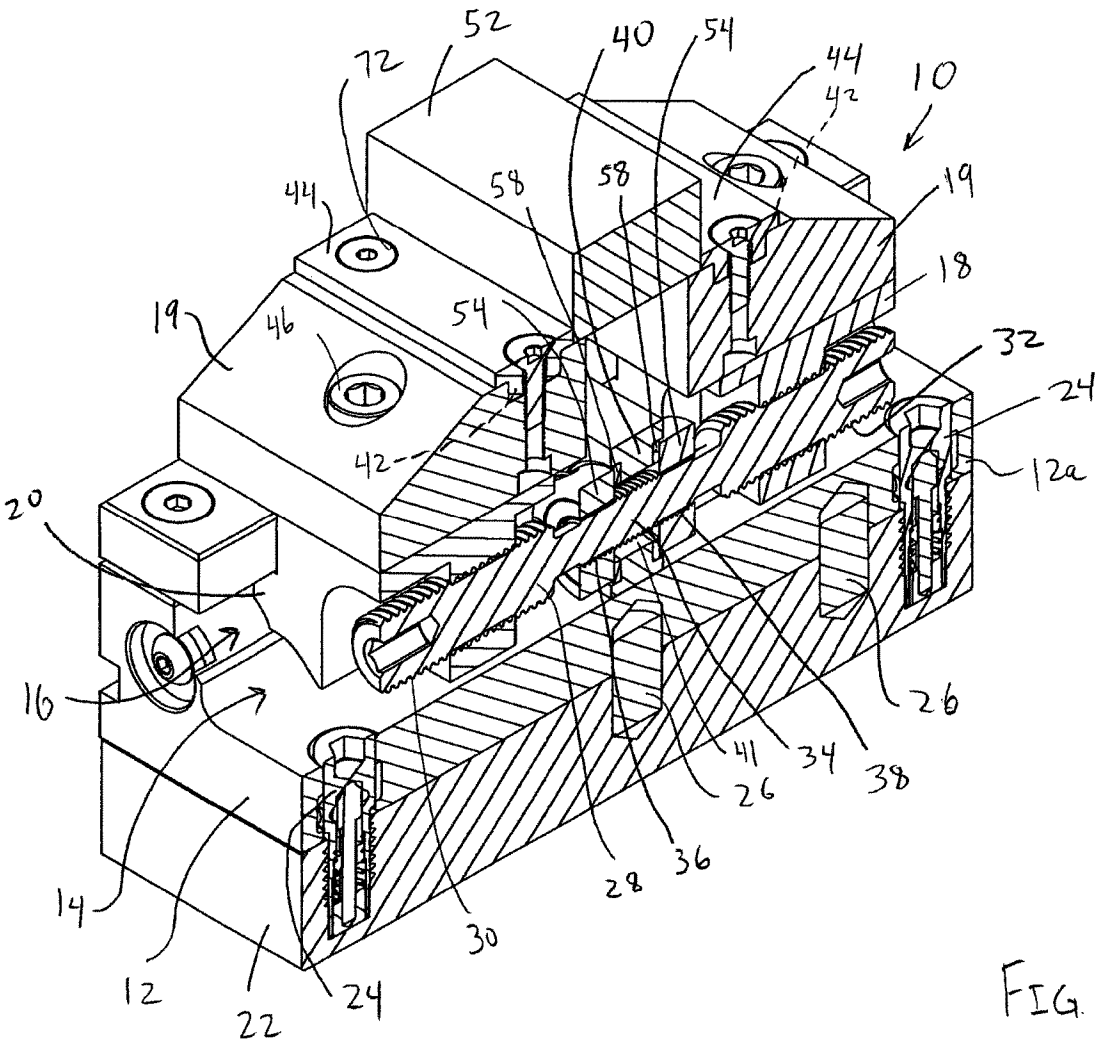
FIG. 2 is an upper perspective, partial cross section view of the vise of FIG. 1, with a pair of jaw inserts added and gripping a workpiece therebetween.
Figure 3:
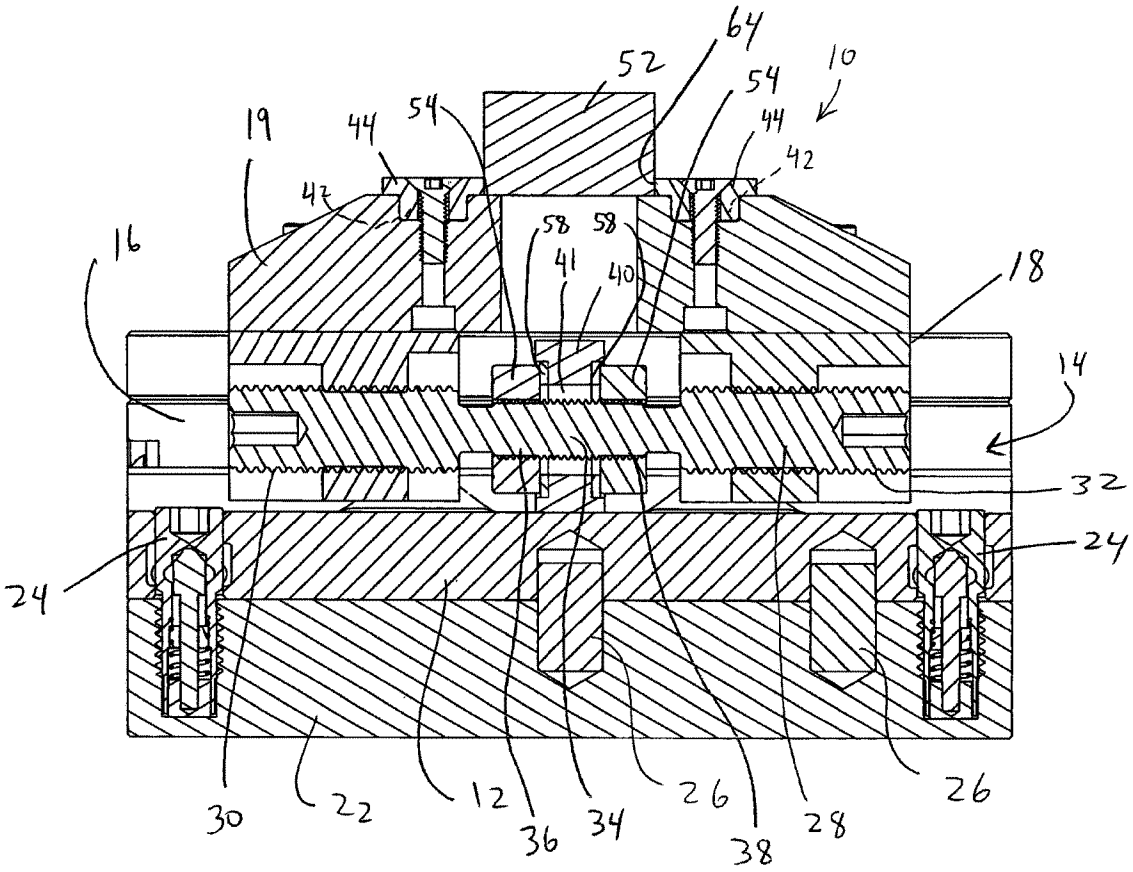
FIG. 3 is a side cross-section of the vise of FIG. 1.
Figure 8:
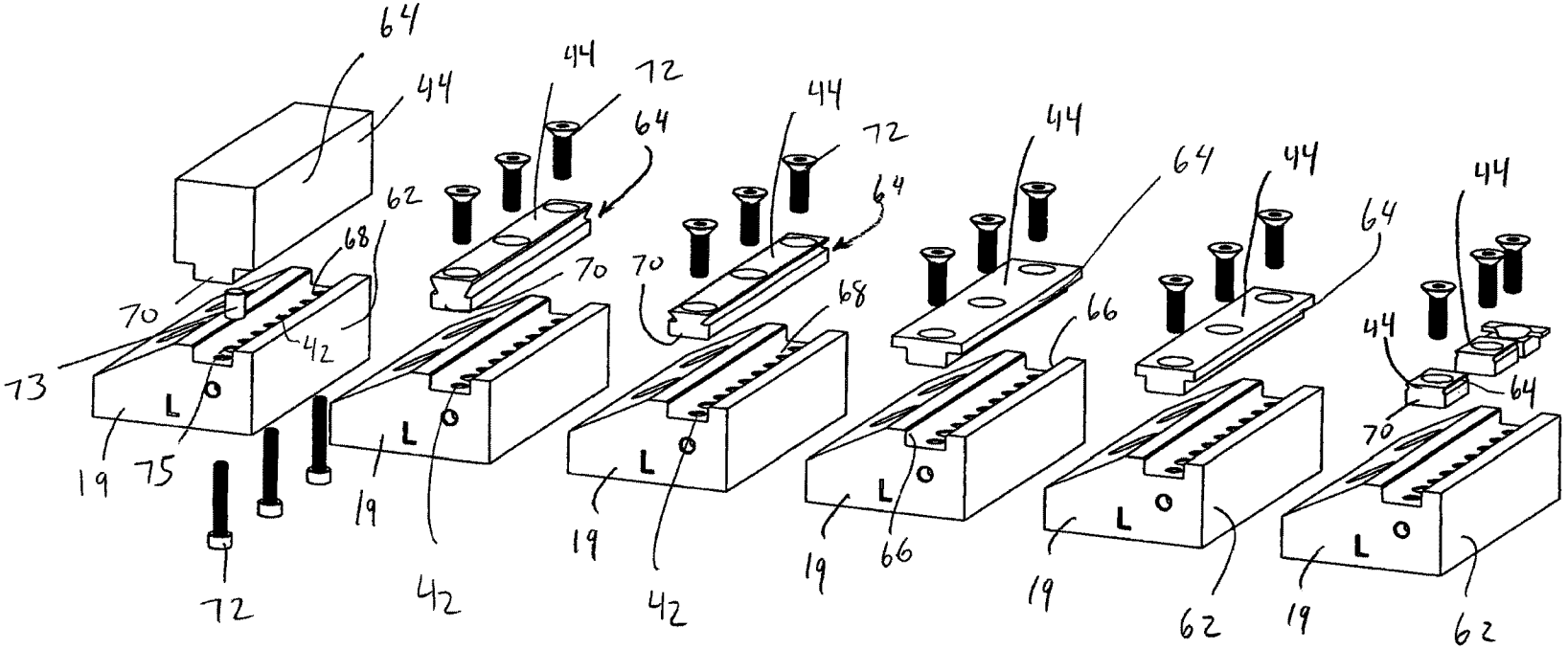
FIG. 8 is a perspective view illustrating a plurality of differing inserts in association with an associated jaw.
Figure 9:
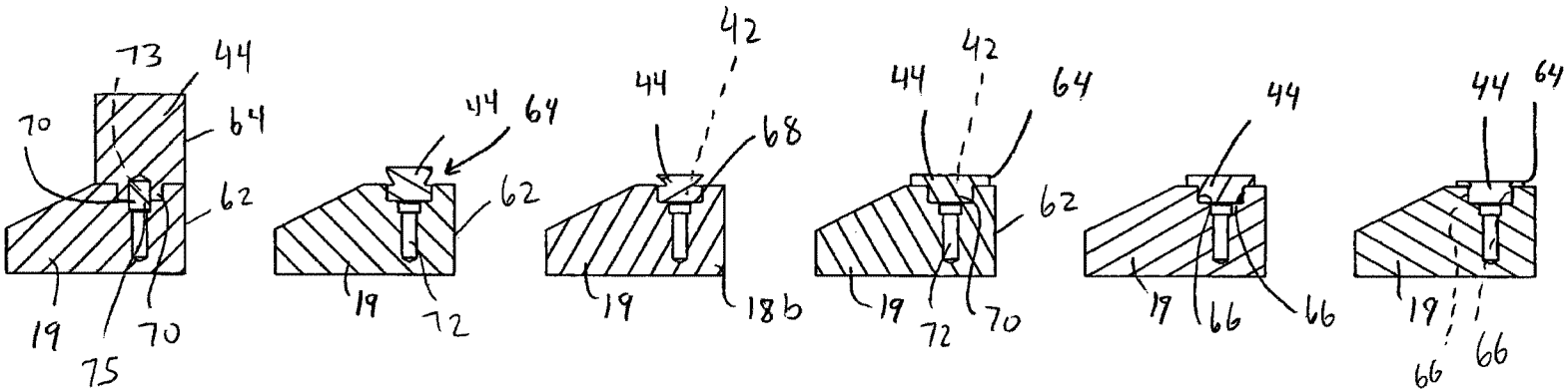
FIG. 9 is cross sections of the inserts and jaws of FIG. 8.

With reference to FIGS. 8 and 9, each insert 44 can be removably coupled to its associated jaw 19/carriage 18. As also noted above, jaw 19 can include an inner face or clamping surface 62 aligned in a plane which is generally perpendicular to the axis of the shaft 28 and the direction of movement of the associated carriage 18. Each insert 44 can also include an inner face or clamping surface 64 oriented in one case generally parallel to the clamping surface 62 of the jaw 19. In certain embodiments (particularly the second, third, fourth, fifth and sixth embodiments shown in FIGS. 8 and 9, in a left-to-right direction), the clamping surface 64 of each insert 44 is recessed from and not aligned with the clamping surface 62 of the associated jaw 19. This configuration enables each workpiece to be clamped or gripped by only the jaw 19 if desired, or only the inserts 44 if desired (as shown in FIGS. 2-4). However, it is not necessarily required that the clamping surface 64 of the inserts 44 be offset from, or misaligned with, the clamping surface 62 of the associated jaw 19. In particular, in the first embodiment of FIGS. 8 and 9, the clamping surfaces 64, 62 of the insert 44 and jaw 19 can be seen to be aligned/co-planar.

Each jaw 19 can include the groove 42 extending transversely across the jaw 19, oriented perpendicular to the axis of the shaft 28 and parallel to the clamping surface 62 of the jaw 19. Each groove 42 can thereby define or include a pair of side walls 66 defining a width of the groove 42 therebetween. Each groove 42 can also include or define a bottom wall 68, which at least partially defines a depth of the groove 42. In the illustrated embodiment, each side wall 66 is generally straight and perpendicular to the axis of the shaft 28, for the entire depth of the groove 42. Each groove 42 can be precision machined to precisely locate the insert 44 along the three planes defined by the two side walls 66 and the bottom wall 68.

The inserts 44 can have various shapes and configurations, as shown in the various embodiments of FIGS. 8 and 9. Each insert 44 can include a protrusion 70 on the underside which has a corresponding shape, and is configured to be closely received in, the associated groove 42, while a remainder of the insert 44 extends outwardly and/or above therefrom in some cases. In the first, second, third, fourth, and fifth embodiments of FIGS. 8 and 9, each insert 44 has the same transverse/lateral dimension (i.e., length) as the jaw 19. However, the insert 44 can have a lesser transverse dimension than the associated jaw 19, and, if desired, multiple inserts 44 can be coupled to the jaw 19 as shown in the sixth embodiment of FIGS. 8 and 9. A set of insert fasteners 72, which extend through the insert 44 and are received in the jaw 19 (in one embodiment are received in the bottom wall 68 of the groove 42) can be utilized to removably secure the inserts 44 to the jaws 19, as shown in the second, third, fourth, fifth and sixth embodiment. The fasteners 72 can thus be oriented perpendicular to the axis of the shaft 28. Alternatively, in the first embodiment of FIGS. 8 and 9 the fasteners 72 extend from an underside of the jaws 19, into the inserts 44.

This configuration of the insert 44/protrusion 70 and jaws 19/groove 42 enables each insert 44 to be removably receivable in the associated groove 42 in a direction perpendicular to the axis of the shaft 28 and parallel to the clamping surfaces 62, 64, to thereby removably couple the insert 44 to the jaw 19. More particularly, each protrusion 70 is directly insertable into the groove 42 in a direction parallel to the depth of the groove 42, and perpendicular to the length of the groove 42, such that the protrusion 70 does not need to slide along the length of the groove 42 when fully received in the groove 42. The protrusion 70 is receivable in the groove 42 in a direction generally parallel to the clamping surface 62, 64, and also generally perpendicular to the shaft 28. This arrangement allows each insert 44 to be easily inserted into place by simply inserting each insert 44 into the groove 42 in the depth direction and avoids having to slide the insert 44 along the entire length of the groove 42, which can require additional clearance space, be prone to sticking or blockage due to foreign bodies, burrs, or warping, and is more difficult to utilize. For example, many dovetail-shaped protrusions/recesses require the insert 44 to be slid the entire length of the groove 42. In one embodiment, then, the protrusion 70/groove 42 arrangement is not dovetail-shaped and, as outlined above, includes straight sidewalls, or includes sidewalls that do not diverge in a direction moving from an outer portion of the groove 42 to a bottom 68 thereof.

However, in some cases it may be possible to utilize side walls 66 which are angled, so as long as the side walls 66 are angled toward each other such that the side walls 66 converge moving in a direction from the upper surface of the jaw 19/groove 42 toward the bottom wall or surface 68; that is, opposite to the diverging arrangement of a dovetail. However this configuration can in some cases make proper location of the inserts 44 more difficult.

As shown in the first embodiment of FIG. 8, the vise 10 may further include a pin 73 oriented generally perpendicular to the shaft 28 and parallel to the fasteners 72 to further secure each insert 44 in place relative to the associated jaw 19. In the illustrated embodiment, the insert 44 includes an opening 75 positioned on the bottom side of the insert 44, and the jaw 19 includes one or a plurality of openings 75 in the bottom wall 68 of the groove 42 to receive the pin 73 therein. If desired, the pin 73 can be permanently coupled to one of the jaws 19 or insert 44 to help secure the insert 44 in place and limit lateral sliding of the insert 44.

It is noted that the vise 10 shown in FIGS. 1-7 incorporates two jaws 19 utilizing two inserts 44 which are movable toward or away from each other to grip a workpiece therebetween. However, the replaceable/modular insert/jaw concept shown in FIGS. 8 and 9 can be utilized in nearly any vise or clamp arrangement, including vises or clamps which include only a single moveable carriage, or two or more carriages, etc. In addition, it should be understood that the position of the protrusion 70 and groove 42 can be reversed; that is, the jaws 19 can include the protrusion 70 and the insert 44 can include the groove 42, while providing the same functionality and benefits described therein. However, it may be more useful to have the groove 42 on the jaws 19 and the protrusion 70 on the insert 44, as positioning the groove 42 on the insert 44 may require additional material to be positioned on the insert 44 to increase the strength thereof, in some cases making the insert 44 bulkier, heaver, and more difficult to handle.

The replaceable/modular nature of the insert 44 enables various insert 44 to be swapped in or out as desired such that the vise 10 can have differing operating characteristics when differing insert 44 and clamping features are desired. In addition, the modular insert 44 arrangement enables insert 44 to be quickly and easily replaced should an insert 44 become damaged, worn, etc. without having to replace or repair an entire jaw 19.

Thus, it can be seen that the vise 10 described and shown herein provides an axial adjustment feature which enables quick, accurate and easy-to-implement axial adjustment of the carriages 18 to ensure precise alignment. The vise 10 also allows inserts 44 to be easily and quickly replaced as desired to provide differing clamping features to the vise 10.

Having described the invention in detail and by reference to certain embodiments, it will be apparent that modifications and variations thereof are possible without departing from the scope of the invention.

What is claimed is:

1. A vise comprising:

a body;

a shaft extending through or positioned adjacent to said body;

a block coupled to said body and spaced away from an axial end of said shaft;

a pair of carriages threadably carried on said shaft and configured such that rotation of said shaft about a central axis thereof causes each carriage to move axially along said shaft; and a pair of clamps releasably coupleable to said shaft and positionable adjacent to said block on opposite sides thereof, wherein each clamp includes two separable clamp portions that are joined together by at least one fastener, and wherein when coupled to said shaft each clamp is adjustable axially along said shaft to enable adjustment of an axial position of said shaft relative to said block, wherein each clamp includes an inner opening receiving said shaft therethrough and is individually fixedly securable to said shaft at an axial location of said shaft by tightening said at least one fastener.

2. The vise of claim 1 wherein each clamp is positioned immediately adjacent to said block on opposite sides thereof to prevent axial movement of said shaft relative to said block.

3. The vise of claim 1 wherein each clamp is threadably coupled to said shaft.

4. The vise of claim 1 wherein said at least one fastener is movable relative to a remainder of the clamp and thereby operable to cause said clamp to grip or release said shaft.

5. The vise of claim 1 wherein said shaft includes an axially inner threaded portion upon which said pair of clamps are threadable, and wherein said shaft further including two opposed, outer portions positioned at opposed axial ends of said shaft, each outer portion being threadably coupled to one of said carriages, and wherein said inner portion has a different diameter than said outer portions.

6. The vise of claim 1 wherein said block has an opening receiving said shaft therethrough, and wherein each clamp is larger than said opening such that each clamp is not receivable through said opening.

7. The vise of claim 1 wherein said block has an opening receiving said shaft therethrough, and wherein said shaft is spaced away from and does not engage said block.

8. The vise of claim 1 wherein said block is positioned at or adjacent a center of said vise with respect to an axial dimension thereof extending parallel to said shaft.

9. The vise of claim 1 wherein each clamp is releasably coupled to said shaft and positioned adjacent to said block on opposite sides thereof.

10. The vise of claim 1 wherein the body has a channel and the pair of carriages are at least partially positioned in the channel, wherein each clamp is positioned such that each clamp is manually adjustable axially along said shaft by a reaching into the channel from a first side of said body to enable adjustment of an axial position of said shaft relative to said block, and wherein each clamp is manually releasably coupleable to said shaft by a user reaching into the channel from the first side of said body.

11. The vise of claim 1 wherein each carriage includes a plurality of holes formed therein and receiving a pin therein oriented in a direction perpendicular to said shaft, said vise further including a pair of jaws, each jaw having openings that are alignable with said openings and pins of a corresponding one of said carriages to receive associated pins therein and thereby align and removably couple said carriages and said jaws.

12. The vise of claim 1 wherein each clamp is individually fixedly coupleable to said shaft in both axial directions along said shaft, and wherein each clamp is individually uncoupleable relative to both axial directions of said shaft while the other clamp remains fixedly coupled relative to both axial directions of said shaft.

13. The vise of claim 1 wherein each clamp is individually fixedly coupleable to said shaft in a rotational direction.

14. The vise of claim 1 wherein each clamp includes two separable clamp portions that are joined together by at least two fasteners.

15. A vise comprising:

a body having a channel;

a shaft extending through or positioned adjacent to said body;

a block coupled to said body and spaced away from an axial end of said shaft;

a pair of carriages threadably carried on said shaft and at least partially positioned in the channel, the pair of carriages being configured such that rotation of said shaft about a central axis thereof causes each carriage to move axially along said shaft; and a pair of clamps positionable adjacent to said block on opposite sides thereof, wherein said shaft includes an axial inner threaded portion upon which said pair of clamps are threadable, said shaft further including two opposed, outer threaded portions positioned at opposed axial ends of said shaft, each carriage being threadably coupled to one of said outer portions, and wherein said inner portion has a different diameter than said outer portions.

16. The vise of claim 15 wherein said inner portion has a smaller diameter than said outer portions, and wherein part of said inner portion is positioned on one side of said block and another part of said inner portion is positioned on another, opposite side of said block.

17. A vise comprising:

a body having a channel;

a shaft extending through or positioned adjacent to said body;

a block coupled to said body and spaced away from an axial end of said shaft, the block having an opening defining an inner surface, said opening receiving the shaft therethrough;

a pair of carriages carried on said shaft and at least partially positioned in the channel, the pair of carriages being configured such that rotation of said shaft about a central axis thereof causes each carriage to move axially along said shaft; and a pair of clamps positionable on the shaft at a location adjacent to said block on opposite sides thereof, and wherein each clamp is configured to directly or indirectly engage an outer end surface of the block at least partially spaced away from said inner surface such that each clamp is not receivable through said opening.

* * * * *